US006609565B1

(12) United States Patent
Andreychuk et al.

(10) Patent No.: US 6,609,565 B1
(45) Date of Patent: Aug. 26, 2003

(54) TROLLEY AND TRAVELING BLOCK SYSTEM

(75) Inventors: Mark T. Andreychuk, Cochrane (CA); Emanuel A. Rike, Jr., Richmond, TX (US)

(73) Assignee: Technicoil Corporation, Calgary (CA)

( * ) Notice: Subject to any disclaimer, the term of this patent is extended or adjusted under 35 U.S.C. 154(b) by 135 days.

(21) Appl. No.: 09/688,979

(22) Filed: Oct. 17, 2000

(30) Foreign Application Priority Data

Oct. 6, 2000 (CA) ..... 2322917

(51) Int. Cl.[7] ..... E21B 19/22

(52) U.S. Cl. ..... 166/77.2; 166/85.1; 414/22.51; 175/162

(58) Field of Search ..... 166/77.2, 77.3, 166/77.51, 85.1; 175/87, 162, 173; 414/22.51, 22.61

(56) References Cited

U.S. PATENT DOCUMENTS 4,040,524 A * 8/1977 Lamb et al. ..... 104/112
5,842,530 A * 12/1998 Smith et al. ..... 166/77.2
6,003,598 A * 12/1999 Andreychuk ..... 166/76.1
6,158,516 A * 12/2000 Smith et al. ..... 166/385
6,408,955 B2 * 6/2002 Gipson ..... 166/384
6,431,286 B1 * 8/2002 Andreychuk ..... 166/384

* cited by examiner

*Primary Examiner*—David Bagnell
*Assistant Examiner*—Jennifer R. Dougherty
(74) *Attorney, Agent, or Firm*—Thomas E. Malyszko

(57) ABSTRACT

A trolley hoisting system for use in a rig has a derrick mounted to the rig, a winch line extending from an upper end of the derrick, and a traveling block located at one end of the winch line. An injector trolley has at least one cavity for allowing the winch line passage therethrough and is adapted to engage the traveling block so that the winch line may be used to raise and lower the injector trolley along the derrick. A lock arrangement for fixing the injector trolley to the derrick at an upper end thereof allows the traveling block to extend below the injector trolley for performing other desired tasks on the rig.

20 Claims, 4 Drawing Sheets

TROLLEY AND TRAVELING BLOCK SYSTEM

FIELD OF THE INVENTION

The present invention relates to drilling and servicing equipment for oil and gas wells generally, and in particular relates to a trolley hoisting system for use in rigs which transport and/or operate equipment for continuous coiled tubing drilling, for conventional joined pipe handling and drilling, and/or for wireline applications.

BACKGROUND OF THE INVENTION

Our U.S. Pat. No. 6,003,598 and corresponding Canadian Patent 2,235,555 for a "Mobile Multi-Function Rig" disclose a dual winch arrangement atop a pivotable derrick, or masts, for performing various functions relating to drilling and servicing either oil or gas wells. One of the winch systems, namely the derrick or mainblock winch, is used to raise and lower certain equipment along the mast, such as an injector and lubricator for continuous or coiled tubing (referred to herein as "CT"). A secondary, or fastline, winch is used to manipulate other equipment, such as a blow-out-preventer ("BOP"). For operations requiring use of a traveling block and elevators to lift and lower conventional joined pipe sections, the injector must first be brought to rest at the bottom of the mast and moved laterally out of the plane of the mast. The traveling block and the mainblock winch are then decoupled from the injector so that they are free to manipulate the joined pipe sections as in a conventional derrick.

We have not been able to locate or identify any conventional derricks, whether they use a single winch or a similar multiple (i.e. two or more) winch system, which would allow one winch arrangement to handle multiple tasks without having to decouple the winch from the injector and remove the injector from the mast, or where the injector superstructure is not thereafter interfering with movement of the mainblock winch lines and the joined pipe or other downhole equipment being handled. In particular, there are time and labour costs associated with handling of the injector upon switching tasks. Removal of the injector from the plane of the mast to enable access and use of a winch or hoisting system is labour and time consuming. The costs and difficulties are further augmented if the winch line moving the injector must also be disconnected or moved from the injector mechanism before using it for another desired task. Further, in a multiple winch system where the primary winch line is not disconnected from the injector, the secondary winch is typically slower and has less capacity than the primary line, leading to further inefficiencies.

What is desired therefore is a novel trolley hoisting system for use in rigs, particularly multi-task rigs, which transport and/or operate equipment for oil and gas operations, including continuous coiled tubing drilling and conventional joined pipe handling and drilling operations. The novel system should allow a single winch arrangement to perform various task without having to detach from or connect to the injector, as in some conventional rig arrangements, when switching between tasks. In particular, the winch system should be capable of moving the injector along the rig's derrick and, upon fixing the injector at a desired location along the derrick, the winch should be immediately available for performing other desired tasks, such as a joined pipe operation.

SUMMARY OF THE PRESENT INVENTION

According to the present invention, there is provided in one aspect a trolley hoisting system for use in a rig comprising a winch line extending from an upper end of a rig derrick having a traveling block at a lower end thereof, and an injector housing having at least one cavity for allowing the winch line passage therethrough and being adapted to engage the traveling block so that the winch line may be used to raise and lower the injector and injector housing along the derrick, and a lock arrangement for fixing the injector housing to the derrick at an upper end thereof to allow the traveling block to extend below the injector housing for performing other desired tasks on the rig.

BRIEF DESCRIPTION OF THE DRAWING FIGURES

Embodiments of the invention will now be described, by way of example only, with reference to the accompanying drawings, wherein.

LIST OF REFERENCE NUMBERS IN DRAWINGS

Figure 3:
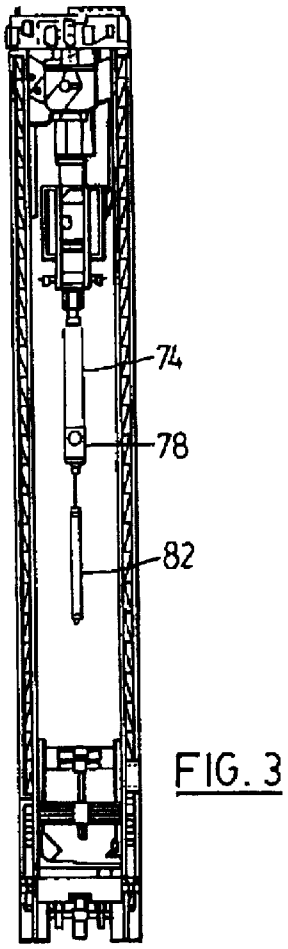
FIG. 3 is a view similar to FIG. 2 but showing the injector fixed, or "parked", at an upper end of the derrick and the traveling block projecting downwardly from the injector's trolley for performing other desired tasks, such as manipulating pipe sections.

10 mobile rig
12 carrier
14 front end of 12
16 rear end of 12
18 cab
20 cartridge assembly
22 ground surface
24 wellhead
26 stabilizers
30 derrick
32 masts (2)
34 passage through masts
36 crown of 30
38 hydraulic legs
39 hollow tubular member
40 safety lock mechanism
42 locating arms
43 hydraulic cylinder for 42
44 locking pin mechanism

46 solenoid
48 pin
50 injector
52 trolley
54 tracks for 50
56 guide/chimney
58 hollow chamber of 56
60 bottom opening of 58
62 slots (4) above 58
64 top end of 56
66 openings on sides of 52
70 winch assembly
72 winch/drive motor
73 control panel
74 steel cables
76 sheaves
78 traveling block
80 loop beneath 78
82 joined pipe

DESCRIPTION OF PREFERRED EMBODIMENTS

Figure 1:
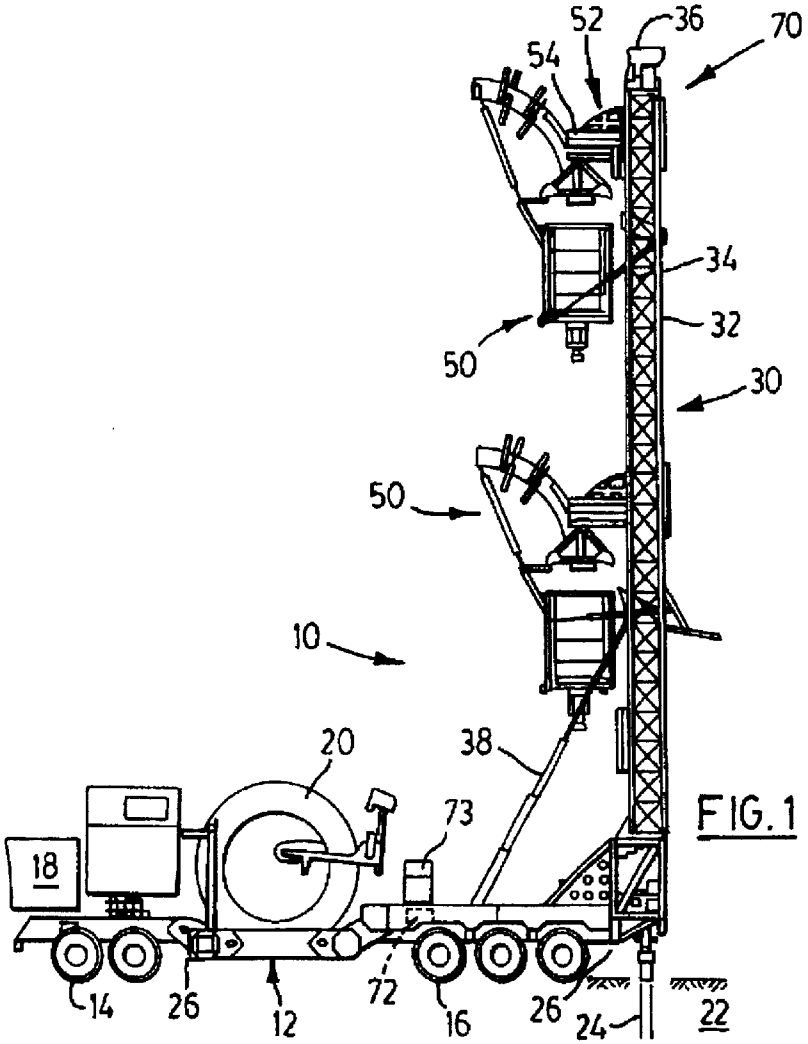
FIG. 1 is a side view of a mobile multi-function rig which employs a trolley and traveling block system according to a preferred embodiment of the present invention showing two selected locations of the injector when moved laterally out of the plane of the rig's derrick.

FIG. 1 shows a mobile rig 10 for transporting drilling and servicing equipment to an oil or gas well site. The equipment, such as a cartridge assembly 20 capable of holding various sizes of continuous or coiled tubing ("CT") reels, is located aboard a self-propelled carrier 12 having a tandem axle front end 14 and a triple axle rear end 16. A cab 18 houses an engine for driving the front and/or rear axles, and incorporates conventional controls for steering the carrier over a ground surface 22 and for locating the carrier's rear end over a well. The term "well" is understood herein to mean either an oil or gas well to be drilled, or an existing well or wellhead 24 which is to be tested or serviced. The carrier 12 incorporates a number of hydraulically operated stabilizers 26 for lifting the carrier off the ground and enhancing lateral stability during well operations. The front and rear axle designs may vary depending on the anticipated weight of equipment to be carried and the type of terrain to be encountered. The carrier's design is generally symmetrical about its longitudinal axis.

The rig 10 incorporates a number of drilling and servicing features aboard the mobile carrier 12, including a derrick or mast 30 pivotally mounted to the rear of the carrier. The derrick is capable of supporting a blow out preventer ("BOP") and an injector 50 for moving CT into and out of the well. The derrick also incorporates a novel single winch arrangement, generally designated by 70. An important advantage of the rig of the present invention over the prior art is that the single winch arrangement 70, in conjunction with novel features of the trolley 52, is designed to perform multiple tasks, such as raising and lowering the injector and lubricator, as well as running joined pipe segments, handling various lengths of down hole tools, and hoisting other equipment as may be needed, including wireline equipment.

Figure 2:
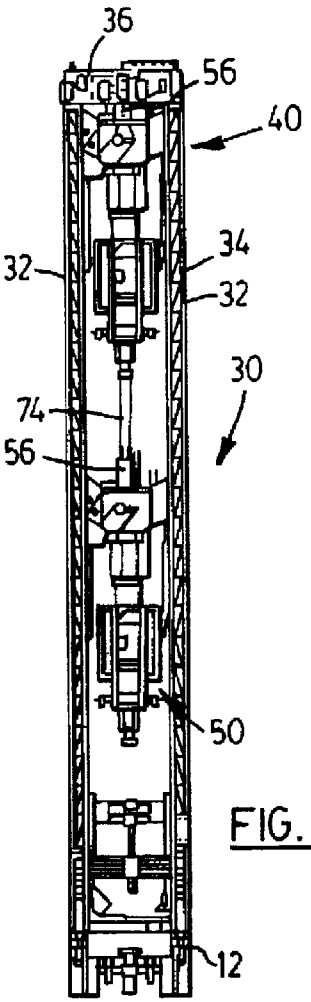
FIG. 2 is an end view of the derrick of the rig of FIG. 1 showing the traveling block supporting the trolley and injector in two selected locations.

Referring now to the derrick 30 in some greater detail, it has two longitudinally spaced mast members 32 (as best seen in FIGS. 2 & 3), each formed by a triangular (in cross-section) truss arrangement having a longitudinal central passage 34 along its length. The masts 32 are joined at the top end by a generally hollow structural tie member, or crown 36, housing a pair of conventional pulley wheels (also referred to as "drums" or "sheaves") of the winch assembly 70. In the embodiment shown the sheaves are grooved to accept ⅞ inch (about 22 mm) wire rope or like cables. The derrick shown is about 60 feet (about 18 m) in length from ground to crown so as to accommodate multiple sections of conventional joined pipe 82. A telescoping hydraulic cylinder or leg 38 is attached to each mast, and is operated from a control panel at the rear of the carrier, to tilt the derrick 30 between a transportation mode and an operating mode, as set out in more detail in applicant's U.S. Pat. No. 6,003,598.

A drive unit, namely in this case a hydraulic winch 72, of the winch assembly 70 is located underneath the carrier's deck and is operated via an upstanding control panel 73. The control panel 73 is folded out onto the side of the carrier when bringing the derrick to rest on the carrier's deck for transport. The winch 72 incorporates two sets of steel cables 74, each set extending up a respective mast through its open passage 34 and over a respective sheave in the crown 36. The cables 74 then extend downwardly away from the crown and about respective rotatable pulleys or sheaves 76 which operatively engage and support a "traveling" block 78. The sheaves and block are sometimes referred to as a "block and tackle" arrangement. A loop element 80 is bolted to the bottom of the block 78 for attaching and carrying drilling/servicing equipment or other loads. The winch 72 therefore controls the movement of the traveling block 78 along the elevated derrick 30 for performing desired functions.

Referring now more particularly to the injector 50, a cradle or trolley 52 supports the injector and rides on the masts' rails 32 to guide the injector to any number of desired locations along the derrick, with two selected locations being illustrated in FIGS. 1 & 2. The trolley has a set of tracks 54 for moving the injector laterally (i.e. perpendicularly to the plane of the derrick) out of the derrick. In the embodiment shown, the tracks 54 provide up to 54 inches of lateral movement, and the trolley is capable of traveling along the derrick whether the injector is located within the derrick or is slid laterally out of the plane of the derrick.

Figure 4:
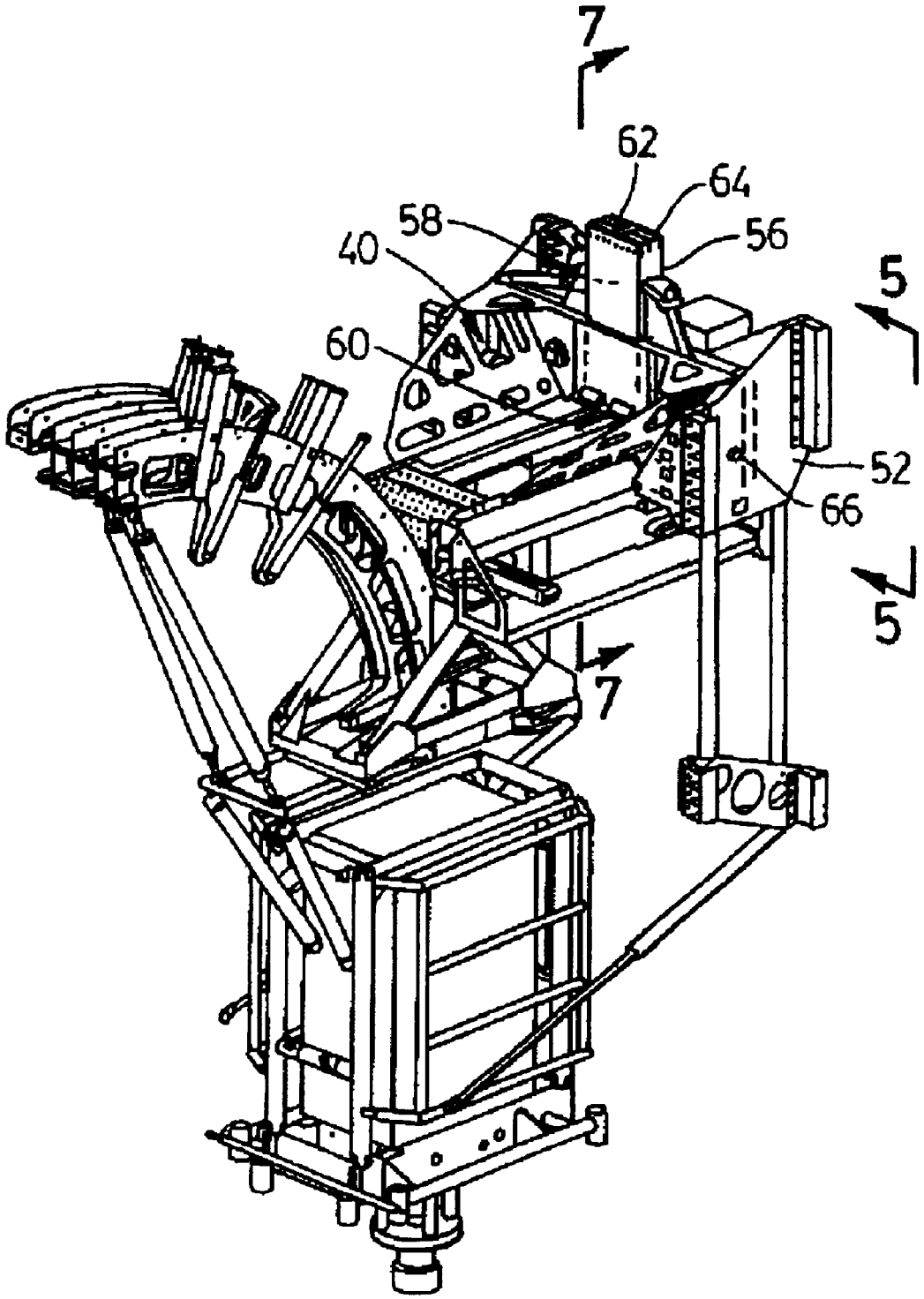
FIG. 4 is an enlarged perspective view of the injector and trolley arrangement in isolation, providing a closer view of a chimney for receiving the traveling block.
Figure 5:
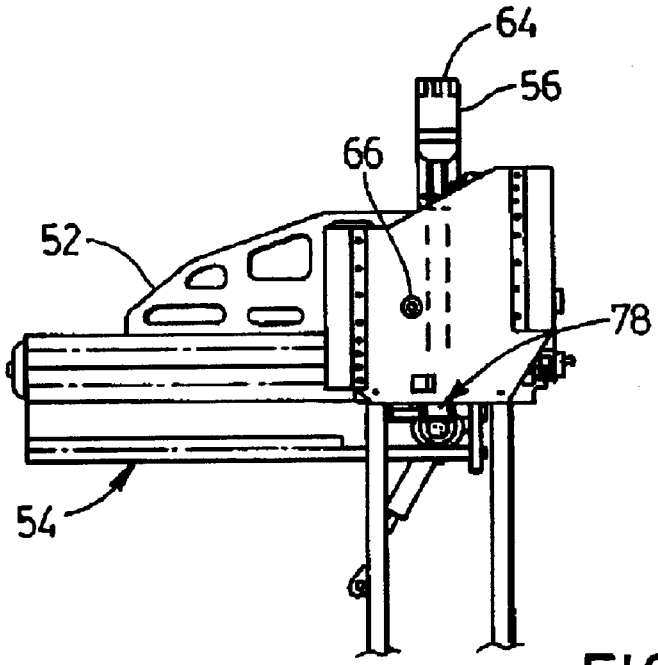
FIG. 5 is a side view along line 5—5 of an upper portion of the trolley of FIG. 4.
Figure 6:
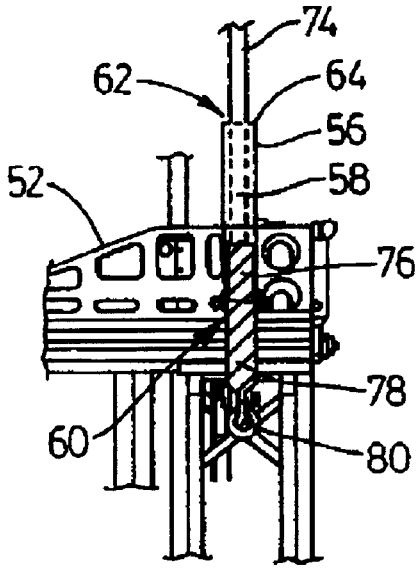
FIG. 6 is a transparent view of FIG. 5 showing the traveling block supported by its cables exiting/entering a bottom end of the chimney.

An important aspect of the present invention is the manner in which the traveling block 78 engages and moves the trolley along the derrick, and in which the cables 74 extend through the trolley. Referring now to FIGS. 4 to 6, a central portion of the trolley 52 has an upwardly extending trolley guide or sleeve 56 (also referred to as a "chimney stack"), with a hollow interior chamber 58 configured to receive the traveling block 78 trough a bottom opening 60. Each winch cable 74 extends through a respective one of four spaced slots 62 in the top end 64 of the chimney 56. Hence, when the traveling block is located inside the chimney in an abutting relationship with the chimney's top end 64 for supporting the weight of the injector 50 and trolley 52, the winch assembly is capable of controlling the location and travel of the injector and trolley along the derrick.

Figure 7:
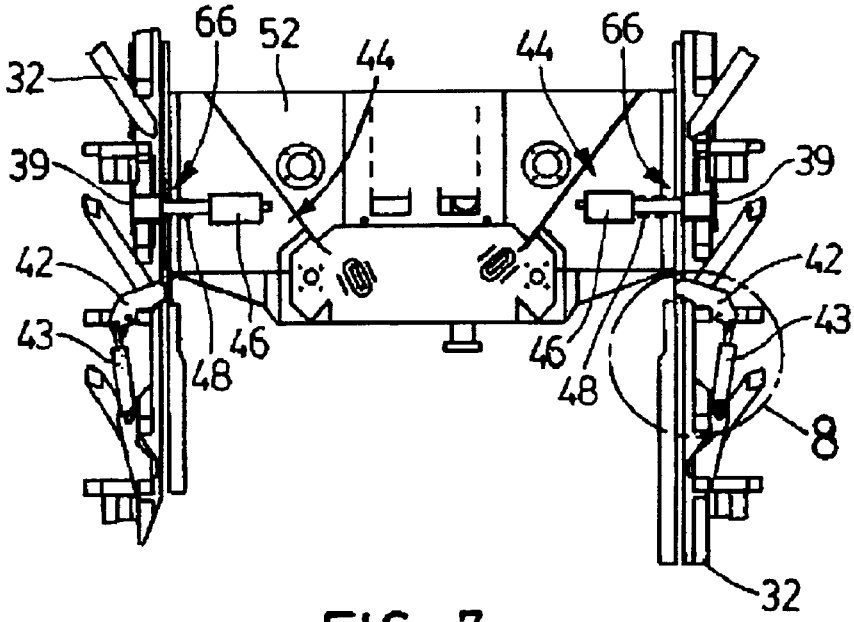
FIG. 7 is a cross-sectional view along line 7—7 of an upper portion of the trolley of FIG. 4 to show a safety lock mechanism of the present invention; and, FIG. 8 is a close-up view of the circled area in FIG. 7, indicated by reference numeral 8, showing the locating arms of the safety lock mechanism.
Figure 8:
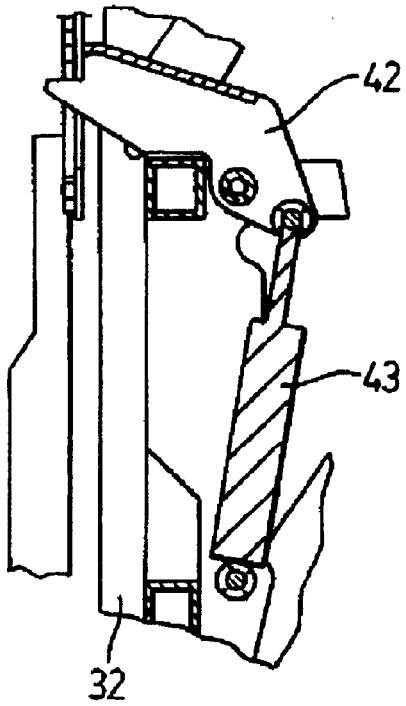

An additional feature of the present invention is a hydraulically and remotely operated "safety lock" mechanism 40 below the crown of the derrick for securely locking the trolley to the top of the derrick as shown in FIG. 3. Referring as well to FIGS. 7 and 8, the masts incorporate a crown saver switching mechanism which is tripped by an upwardly moving trolley as it nears the crown 36 to slow the winch assembly and prevent collision of the trolley with the crown. Once tripped, the switching mechanism activates a pair of actuators, namely hydraulic cylinders 43, one on each mast, to pivot outwardly (i.e. counterclockwise) respective locating arms 42 from the masts for positioning underneath the trolley 52. The trolley is then lowered a short distance onto the locating arms 42, allowing the arms to take up the weight of the seated trolley. Such seating results in alignment of an opening 66 on each side of the trolley with a respective hollow tube 39 mounted on the masts. A locking pin mechanism 44 is mounted on the trolley adjacent each opening 66. A solenoid 46, or like hydraulic cylinder, is activated to extend a pin 48 through the opening 66 and into the tube 39 to lock the trolley to the top of the derrick at the location shown. Sensors are provided for detecting/confirming that the pins are either safely engaged (or disengaged, as the case may be) with the mast. The injector is then moved to a "parked" position out of the plane of the derrick (as illustrated in FIG. 1), and the traveling block 78 may now be lowered out of engagement with the chimney 56 and below the trolley for performing other tasks, such as running conventional joined pipe 80 if desired, as illustrated in FIG. 3. The safety lock mechanism 40 is preferably operable from the same console 73 as the trolley, and incorporates indicators which communicate with the sensors to confirm that the arms 42 and pins 48 are in their desired orientations, either safely engaged or disengaged with the trolley/masts, as the case may be. In addition, the arms 42 have indicators thereon for additional visual confirmation from ground level that the arms 42 are in their desired orientation.

An example of a typical multi-task operation for the rig 10 may now be described. With the derrick 30 in a raised and operative position, the traveling block 78 is pulled via cables 74 into the trolley's chimney 56 and is tensioned so as to carry the weight of the trolley 52 and associated equipment, including the injector 50. With the safety lock mechanism 40 unlocked, the winch 72 is then used to move the trolley to a desired location on the derrick to perform a first set of tasks, such as CT operations. When it is desired to switch tasks which do not require use of the injector, such as a joined pipe operation, the winch mechanism pulls the traveling block, together with the trolley and injector, to the top of the derrick and the safety lock mechanism 40 is activated to lock the trolley in place with the locating arms 42 and the locking pin mechanism 44. The injector is moved out of the way along the tracks 54 into the parked position, allowing the winch to drop the traveling block 78 out of the chimney 56 and through the trolley to perform the joined pipe operation independently of the trolley. When the trolley and injector must be used again, the reverse steps are taken. The block 78 is brought back up into the chimney 56, weight is taken up by the cables 74, and the safety lock mechanism 40 is released (i.e. the solenoids 46 disengage the pins 48 and the locating arms 42 are moved out of the way by cylinders 43) to make the trolley operational.

It will now be appreciated that, among other advantages, the present invention eliminates the need for a secondary fastline winch at the derrick's crown for performing other tasks, such as manipulating the BOP. The novel trolley and traveling block system allows a single winch arrangement to perform various task without having to detach from or connect to the injector, as in some conventional rig arrangements, when switching between tasks. In particular, the present system is capable of moving the injector along the rig's masts and, upon fixing the injector at a desired location along the masts, the traveling block is immediately available for performing other desired tasks, such as a joined pipe operation.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, it is understood that the trolley and traveling block system of the present invention is not restricted to use aboard a self-propelled carrier, but may be used in conjunction with other arrangements of equipment, such as on a derrick aboard a trailer which is pulled by a tractor truck.

We claim:

1. A hoisting system for a derrick comprising:

a winch assembly for operating winch lines from an upper end of said derrick;

a block member supported by said winch lines; and, a trolley mountable on said derrick for travel therealong and having a means for allowing passage of said winch lines through said trolley, said trolley being operable in a first mode wherein said block member is engaged with said trolley to allow said winch assembly to move said trolley along said derrick, and in a second mode wherein said trolley is movably fixed relative to said derrick to allow said winch assembly to extend said winch lines and block member below said trolley for performing desired tasks.

2. The hoisting system of claim 1 wherein said means for allowing passage comprises a hollow casing having a top end with at least one slot for passing said winch lines therethrough and an open bottom end to receive said block member in abutting contact with said casing for transferring weight of said trolley to said winch lines.

3. The hoisting system of claim 1 further including a lock arrangement for fixing said trolley to said upper end of said derrick comprising at least one locating arm mountable to said derrick and adapted for engagement with said trolley to support the weight thereof during said second mode.

4. The hoisting system of claim 3 wherein said lock arrangement further includes at least one locking pin mechanism mountable to said trolley for slideably engaging said derrick to lock said trolley adjacent said upper end of said derrick.

5. The hoisting system of claim 3 further including a switching mechanism mountable to said derrick, said switching mechanism being adapted to be tripped by an upwardly moving trolley to prevent collision with said upper end of said derrick and for activating said locating arms.

6. The hoisting system of claim 1 further including a lock arrangement having at least one locking pin mechanism mountable to said trolley for slideably engaging said derrick to lock said trolley adjacent said upper end of said derrick.

7. The hoisting system of claim 6 further including a switching mechanism mountable to said derrick, said switching mechanism being adapted to be tripped by an upwardly moving trolley to prevent collision with said upper end of said derrick.

8. The hoisting system of claim 1 further including a switching mechanism mountable to said derrick, said switching mechanism being adapted to be tripped by an upwardly moving trolley to prevent collision with said upper end of said derrick.

9. A derrick having a trolley hoisting system comprising:

a winch assembly having a cable system extending from a first end of said derrick;

a block member operatively engaged to said cable system;

a trolley slideably mounted to said derrick and having a guide member for allowing extension of said cable system through said trolley, said guide member being adapted to engage said block member so that the cable system may be used to raise and lower the trolley along the derrick; and, a lock arrangement for securing the trolley to the derrick proximate said first end to allow the block member to extend away from said trolley for performing other desired tasks.

10. The derrick of claim 9 wherein said guide member comprises a hollow casing with a first end having a slot means for providing passage for said cable system through said casing, and an open second end for allowing said block member to nest with said casing to carry the weight of said trolley.

11. The derrick of claim 9 wherein said lock arrangement includes a locating means on said derrick comprising at least one arm pivotally mounted to said derrick for location between an engaged position with said trolley for supporting the weight thereof and a disengaged position to avoid interference with travel of said trolley along said derrick.

12. The derrick of claim 11 wherein said lock arrangement further includes at least one locking pin mechanism on said trolley for slideably engaging said derrick to lock said trolley adjacent said first end of said derrick.

13. The derrick of claim 12 wherein said locking pin mechanism comprises a solenoid activated pin for mating with a female member on said derrick.

14. The derrick of claim 12 further including a switching mechanism on said derrick adapted to be tripped by a trolley approaching said first end of said derrick to prevent collision therewith and for activating said locating means to said engaged position.

15. A rig for drilling and servicing oil and gas wells comprising:

a generally longitudinal derrick having an upper end and a lower end pivotally mounted to a portion of said rig;

a winch assembly having a winch line extending downwardly from said upper end of said derrick;

a block member supported by said winch line;

a trolley for carrying an injector, said trolley being slideably mounted on said derrick for travel therealong, said trolley having a guide member for allowing passage of said winch line through said trolley and for mating with said block member so that said winch line may be used to raise and lower said trolley along said derrick; and a lock arrangement for fixing the trolley adjacent said upper end of said derrick to allow the winch line and block member to extend below said trolley for performing additional rig tasks.

16. The rig of claim 15 wherein said trolley is adapted to move said injector to a location out of the plane of said derrick to allow for unobstructed passage of said winch line and block below said trolley.

17. The rig of claim 16 wherein said guide member comprises a upstanding hollow casing with a top end having a plurality of slots for providing passage for said winch line through said casing and an open bottom end for allowing said block member to nest with said casing in abutting contact with said top end to carry the weight of said trolley.

18. The rig of claim 17 wherein said lock arrangement includes a locating means comprising at least one hydraulically operable arm pivotally mounted to said derrick for location between an engaged position with said trolley for supporting the weight thereof and a disengaged position to avoid interference with travel of said trolley along said derrick.

19. The rig of claim 18 wherein said lock arrangement further includes at least one locking pin mechanism on said trolley for slideably engaging said derrick to lock said trolley adjacent said upper end of said derrick.

20. The rig of claim 19 further including a switching mechanism on said derrick adapted to be tripped by a trolley approaching said upper end of said derrick to prevent collision therewith and for activating said locating means to said engaged position.

* * * * *